United States Patent [19]

Underwood

[11] 4,050,341

[45] Sept. 27, 1977

[54] ELECTROMAGNETIC PICKUP FOR STRINGED MUSICAL INSTRUMENTS

[76] Inventor: John F. Underwood, 530 S. Hampton, Orlando, Fla. 32803

[21] Appl. No.: 657,266

[22] Filed: Feb. 11, 1976

[51] Int. Cl.[2] ..... G10D 5/00; G10H 3/08

[52] U.S. Cl. ..... 84/1.15; 84/1.16

[58] Field of Search ..... 84/1.15, 1.16; 179/1 M

[56] References Cited

U.S. PATENT DOCUMENTS

| | | | |
|---|---|---|---|
| 2,972,922 | 2/1961 | Rhodes | 84/1.15 |
| 2,976,755 | 3/1961 | Fender | 84/1.15 |
| 3,657,461 | 4/1972 | Freeman | 84/1.15 |

*Primary Examiner*—E. S. Jackmon

*Attorney, Agent, or Firm*—Craig & Antonelli

[57] ABSTRACT

An electromagnetic pickup is provided for musical instruments, particularly of the type having vibrating magnetizable strings, which pickup device includes a permanent magnet having a configured surface adjacent to the magnetizable strings to provide a varying magnetic field effecting respective ones of the strings in accordance with their magnetizability, and a low impedance coil surrounding the permanent magnet. The permanent magnet is a rectangular bar magnet being magnetized perpendicularly to the configured surface, with the configured surface providing a cross-sectional variation of a dimension of the bar magnet, thereby varying the magnetic field effecting the different strings. Particular cross-sectional variations of this dimension are included, each of which achieves the natural tone of the respective strings and enhances the balance therebetween of the pickup output.

21 Claims, 11 Drawing Figures

ELECTROMAGNETIC PICKUP FOR STRINGED MUSICAL INSTRUMENTS

The present invention relates to an electromagnetic pickup for stringed musical instruments, and more particularly involves a permanent bar magnet having a configured shape or surface adjacent to the strings of the musical instrument for varying the magnetic field effecting the respective strings in accordance with their magnetizability.

Various arrangements have been contemplated for magnetic pickups for stringed musical instruments for the purposes of achieving volume amplification of the vibrating strings, together with an acceptable tone quality and uniformity of the amplified sounds produced by the musical instrument. Such arrangements have included the provision of a plurality of magnetic elements adjacent to each of the strings of the musical instrument which magnetic elements may be adjustable with respect to the strings to achieve natural tones and desired amplification of these tones. Although such arrangements consider the variation of the magnetic field associated with the respective strings, each of which has varying degrees of magnetizability because of their construction, these prior arrangements have involved complex constructions which leave the selection of the tone quality of the strings subject to considerable adjustments.

Other arrangements have contemplated permanent magnet type structures which vary the magnetic field effecting the various strings of the musical instruments by placing a plurality of permanent magnets having variable magnetic polarizations adjacent to the respective strings. These prior arrangements also involve considerably complex constructions. A further prior arrangement for a magnetic pickup for an electric guitar has contemplated the use of separate pickups for the wound and unwound strings of the electric guitar. The diameter of the string, as well as the winding, provide different magnetizability of the wires which are effected by the magnetic field of the respective pickups.

The present invention achieves a pickup in which the natural tone response is provided for each string with high clarity. This electromagnetic pickup, according to the present invention, allows high volume amplification techniques while still retaining a true natural tone for each string, and reducing hum and feedback in the amplified sound of the musical instrument.

These aspects of the present invention are provided efficiently and economically in a relatively simple construction which includes a permanent magnet having a configured surface adjacent to the strings of the musical instrument for varying the magnetic field effecting the respective strings of the musical instrument. The configured surface provides a varying size of one dimension of a permanent bar magnet in accordance with the degree of magnetizability of the adjacent string. By this means, the magnetic mass adjacent to each respective string is varied in accordance with the magnetization of the string, thereby balancing the response from each string, while achieving a pickup of the natural tone of the string.

In particular, the magnetic pickup in accordance with the present invention advantageously enables the strings of an acoustic guitar to be amplified at a high gain without destroying the natural response and clarity of each string and considerably reducing hum and feedback of the amplified sound. Accordingly, the acoustic guitar can be electronically amplified while retaining the natural tone quality of each of the strings. An acoustic guitar utilizes bronze strings which are wound, and thereby have varying degrees of magnetization in terms of the magnetic mass and magnetic material of the respective strings. The construction of the magnetic pickup in accordance with the present invention enables a variation of the magnetic field effecting these strings of the acoustic guitar in order to bring out the natural tone without severe amplification of some strings over others such that the response from each string is balanced.

It is an object of the present invention to provide an electromagnetic pickup device for a musical instrument of the type having elongated magnetizable vibrating elements, which pickup device achieves a balanced, natural tone quality of the musical instrument at high amplification.

Another object of this invention is to provide an electromagnetic pickup device for musical instruments having elongated magnetizable vibrating elements, which pickup device comprises a permanent magnet having a configured surface adjacent to the magnetizable vibrating elements to provide variation of the magnetic field effecting the respective elements in accordance with their magnetizability, and having a low impedance coil surrounding the permanent magnet.

Still another object of the present invention is to provide an electromagnetic pickup device for musical instruments of the type having elongated magnetic vibrating elements, which pickup device includes a permanent rectangular bar magnet being magnetically polarized perpendicularly to two edge surfaces of the rectangular bar, with one edge surface adjacent to the vibrating elements being configured to provide a varying cross-sectional thickness or width dimension of the rectangular bar magnet in accordance with the variation of magnetic field effecting the respective vibrating elements with respect to their magnetizability.

A further object of the invention resides in the use of an electromagnetic pickup having a permanent magnet being configured with different cross-section dimensions adjacent the respective strings of an acoustic guitar in accordance with their magnetizability, thereby achieving natural tone quality and balance for a pickup of the acoustic guitar at high amplification.

These and other objects of the present invention may be achieved in an electromagnetic pickup device which comprises a permanent magnet having a configured surface adjacent to the magnetizable vibrating elements of a musical instrument, said configured surface providing a variation of the magnetic field effecting respective ones of the elements in accordance with the magnetizability of the elements, and a low impedance coil surrounding the permanent magnet. Moreover, the permanent magnet may be a rectangular bar magnet being magnetically polarized perpendicular to the two longitudinal edge surfaces thereof wherein the configured surface is one of the two edge surfaces and provides a cross-sectional varying thickness or width dimension of the bar magnet facing the vibrating elements. The variation of the cross-sectional thickness or width of the bar bagnet may be achieved in a tapered form, a step form, a notch form and a combination of a notch and step form. The respective variations of the cross-section thickness or width of the permanent magnet are dimensioned in accordance with the amount of pickup to be achieved with the respective strings of the musical instrument.

The output balance of the electromagnetic pickup of this invention can be considerably enhanced by disposing a thin steel shim along the edge surface of the rectangular bar magnet which faces away from the vibrating elements, while another shorter length steel shim is disposed along the edge surface adjacent the vibrating elements only at the reduced cross-sectional thickness or width portions of the bar magnet. In a preferred arrangement for an acoustic guitar, the rectangular bar magnet has an edge surface adjacent the strings of the guitar formed with a stepped portion, thereby providing a smaller width dimension, or magnetic mass, at the treble side. The shorter length steel shim is placed on the edge surface at the reduced width portion of the rectangular bar, and the other longer steel shim is placed along the entire edge surface of the bar magnet opposite to the strings. This construction increases the magnetic field, i. e. increases the power output of the pickup, by means of the longer steel shim at the nonconfigured edge of the bar magnet, while the shorter length steel shim shields the strings of the acoustic guitar at the treble side to maintain balance of the pickup.

The present invention further contemplates the provision of a covering structure for enclosing the permanent magnet and the coil surrounding the permanent magnet which covering structure may be nonmagnetic and includes a spacer material which enables a tapering of the surface of the covering structure adjacent to the configured edge surface of the permanent magnet. In this respect, the covering structure can include two non-magnetic plates adjacent the two edge surfaces of the bar magnet, having the low impedance coil surrounding the permanent magnet, and connected to one another by means of an epoxy resin further surrounding the construction of the permanent magnet and coil. The epoxy resin material may be also utilized as the spacer material between the top cover plate and the configured surface of the permanent magnet providing a taper therebetween. This top rface and configured surface are those placed adjacent to the strings of the musical instrument.

The low impedance coil, or spool, surrounding the magnet, plays an important part in the pickup of the tones of the vibrating strings. In accordance with a further aspect of the present invention, the coil is wound about the bar magnet hving the varying cross-sectional dimension in such a manner as to be tight against the magnet at the larger dimension end, but wound overlappingly at the smaller dimension end of the bar magnet. Thus, at the treble side of the pickup, for instance, the coil windings are spread-out away from the magnet, thereby adding depth to the field created by the magnet. This adds depth, or a more distant response, and a pleasing tone to the sounds picked-up at treble side of the electromagnetic pickup of the present invention. On the other hand, the coil windings will be wound tight against the magnet at the bass end which tend to compress the bass tones, thereby reducing super-low frequencies which cause annoying acoustic feedback. This construction acts as a filter of the super-low frequencies at the bass side, while the musical tones picked up at the treble side are mellowed in that the super-high frequencies are limited and not heard as occurs in natural acoustic sounds.

These and other aspects of the present invention may be achieved and understood by reference to the drawing figures, which provide in non-limitative example the features of the present invention, and wherein FIG. 1 illustrates an acoustic guitar utilizing the electromagnetic pickup according to the present invention;

FIG. 2 illustrates in perspective view the electromagnetic pickup in accordance with the present invention;

FIGS. 3*a* – 3*g* illustrate respective examples of configured cross-sectional thicknesses or widths of the electromagnetic pickup device of the present invention in relation to the strings of a musical instrument;

Figure 1:
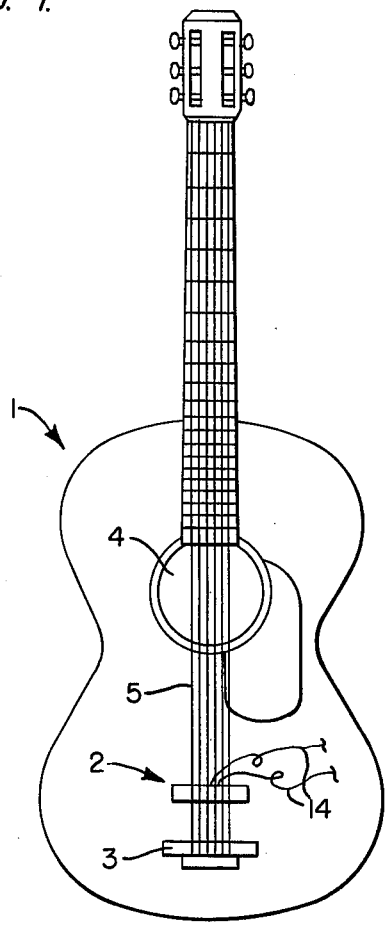

By reference to FIG. 1, an electromagnetic pickup 2 in accordance with the present invention may be placed under the strings 5 of an acoustic guitar 1. The placement of the pickup 2 in accordance with the present invention may be between the bridge 3 of the guitar and the sound hole 4 thereof, and a preferred placement of the pickup is at approximately 2 inches from the bridge 3 between the top of the guitar 1 and close to the strings 5.

Figure 2:
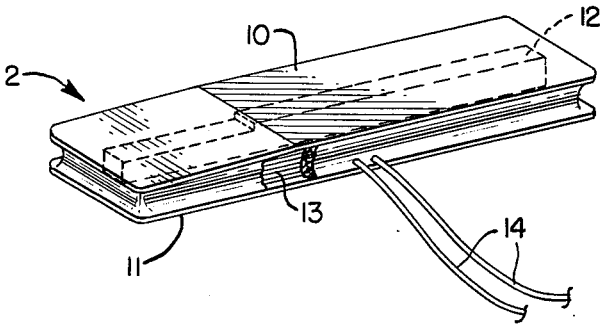

The magnetic pickup of this invention is more fully illustrated by reference to FIG. 2 in which the costruction includes the bar magnet 12 having a generally rectangular shape with respective length, width and thickness dimensions, and being provided between top and bottom covers 10 and 11 of non-magnetic material. A coil 13 surrounds the outer periphery of the bar magnet 12 and includes leads 14 to be attached to the conventional amplifying equipment, which may include preamplifiers. The top and bottom covers may be of plastic non-magnetic materials, or a metallic magnetic shielding material, and can be connected together by means of a synthetic resin material encapsulating the bar magnet 12 and coil 13. This encapsulating material may provide a spacer between the top cover and the configured surface of the bar magnet, such as illustrated in FIG. 3*c* by the spacer 15.

Figure 3A:
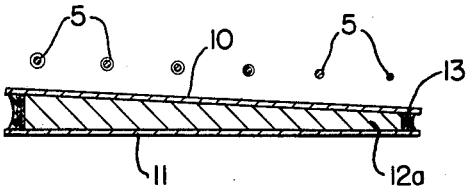
Figure 3B:
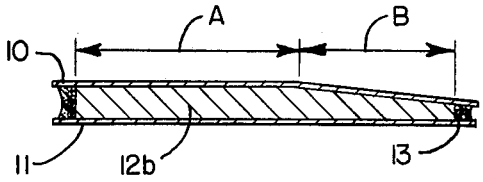

Various configurations of the bar magnet have been found to be effective in achieving the high volume amplification of the acoustic guitar strings, together with natural tone and balance between the pickup of the respective strings. These various configurations may be seen by reference to FIGS. 3(*a*—*g*). For example, the rectangular bar magnet 12*a* in FIG. 3*a* has a tapered edge surface adjacent to the strings of the guitar in order to provide a continuously varying change of magnetic mass adjacent to the strings 5 which include steel wound bronze strings at the bass side and unwound steel strings at the treble side. A further example of this type of structure may be seen in FIG. 3*b* in which the taper is only provided over the length B of the bar magnet 12*b*, which length corresponds to the two unwound strings of the guitar. As an example, the distance A may be 1½ inches, while the tapered distance B may be 1 inch, with the taper to be as great as one-half of the width dimension of the rectangular bar magnet 12*b*.

Figure 3C:
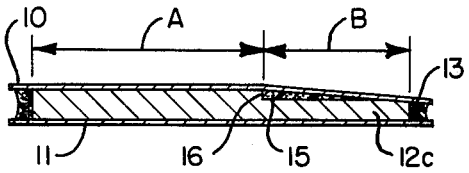

A further variation may be seen in FIG. 3*c* in which the length of the edge surface of the bar magnet 12*c* is stepped at a step 16. In this instance, a spacer of the material encapsulating the coil and bar magnet may be provided between the reduced width of the bar magnet 12*c* at the stepped edge surface and the top cover 10 although the cover 10 may be provided with a slight taper at this end of the bar magnet.

In this embodiment, the rectangular bar magnet 12c may have a width dimension over the length A ranging from 0.100 to 0.160 inches, while the step portion over the length B may range from 0.050 to 0.090 inches. A preferable range of these dimensions may be 0.120 inches for the length A, and 0.060 inches over the length B such that the step width is about one-half that of the larger end of the magnet. These ranges of dimensions of the cross-sectional widths of the rectangular bar magnet vary the magnetic mass appropriate to the magnetizability of the respective strings adjacent to the edge surface of the magnet. In this arrangement of FIG. 3c, the length A may also be about one and one-half inches, while the length B may be 1 inch.

Figure 3D:
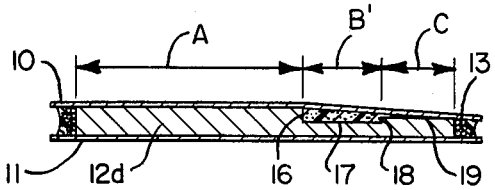

In the construction of FIG. 3d, the bar magnet 12d is stepped at the step 16 and includes a notch edge surface portion 17 with a further edge step surface portion 19 at the step 18. The further edge step surface portion 19 may provide a reduced width of the rectangular bar than that of the end of the bar magnet 12d over the length A.

In this regard, the embodiment of FIG. 3d may provide a width range of from 0.130 to 0.200 inches over the length A, 0.050 to 0.090 inches over the notch surface portion B', and 0.070 to 0.120 inches over the secondary step portion C. A preferable construction of this embodiment includes the cross-sectional width of the rectangular magnet 12d as 0.160 inches over the length A, 0.080 inches over the notch portion B', and 0.095 inches over the step portion C. The various lengths A, B and C of the magnet 12d may be about 1½ inches, ½ inch, and ½ inch, respectively.

Figure 3E:
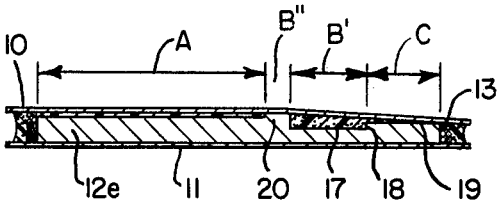

The pickup in FIG. 3e includes a bar magnet 12e having a uniform cross-sectional width over the length A, an upward edge step surface portion 20 over the length B", the downward edge notch surface portion 17 over the length B' and an upward edge step surface portion 19 over the length C. In this embodiment, the cross-section width of the bar magnet 12e over the length A may range from 0.140 to 0.180 inches, while the step surface portion 20 is at an increased width over the distance B" ranging from 0.015 to 0.035 inches over that of the length A. The notch surface portion over the distance B' may have a width range from 0.050 to 0.100 inches, while the step surface portion 19 may be at a width ranging from 0.070 to 0.120 inches. Again, a preferred embodiment of this construction of FIG. 3e provides a width of the rectangular bar 12e of 0.140 inches over the length A, an increased width ranging from 0.020 to 0.030 inches at the step surface portion 20, a width in the notch surface portion 17 of 0.080 inches and a width at the step surface portion 19 of 0.095 inches.

In this construction of the magnet 12e, the length B" may range from three-sixteenths to three-fourths inches, the length B' may be one-half inch, and the length C may be one-half inch, while the overall length of the magnet 12e is preferably maintained at about 2½inches.

Of these embodiments illustrated in FIGS. 3c – 3e, the magnetic pickup provided from the bar magnet 12c is easily manufactured and provides a reasonable balance between the pickup of the strings. On the other hand, the bar magnet 12d increases the balancing of the pickup while achieving a natural tone of the strings, and the bar magnet 12e provides a pickup in which the balancing between the strings is most completely accomplished.

Figure 3F:
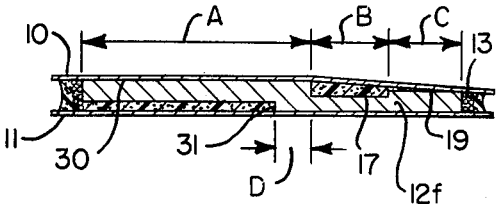

The structure illustrated in FIG. 3f has been designed for high volume acoustical guitar application where clear, crisp bass is achieved without being overpowering. The treble has been made to sound more distant, but still balanced with the entire sound of the guitar. The G-string has been balanced by having more magnetic masses under the string and an increased portion of the coil windings to pick up this sound. The embodiment of FIG. 3f provides a reduction of booming bass although high volume amplification can be achieved.

In this embodiment, the bar magnet 12f may have a width dimension of about 0.125 over the portion 30 of the bar magnet up to the step 31. The width of the magnet from this step over the distance D may be 0.180 inch, while maintaining the length A at about one and one-half inches and the length D at about three-sixteenth inches. The notch surface portion 17 over the length B of about one-half inch may provide a width of 0.080 inch for the magnet, and the step surface portion 19 over a length C of about one-half inch may provide a width of 0.100 inch.

Figure 3G:
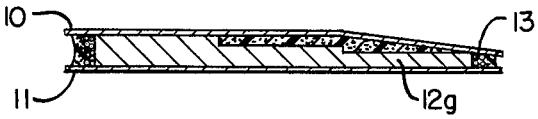

The arrangement in FIG. 3g involves a step bar magnet 12g having three edge step surface portions, each of which provides a different width of the bar magnet. An example of these widths may be 0.215 inch at the wider end, 0.175 inch at the middle portion of the bar magnet, and 0.125 inch at the treble end of the bar magnet.

Figure 4:
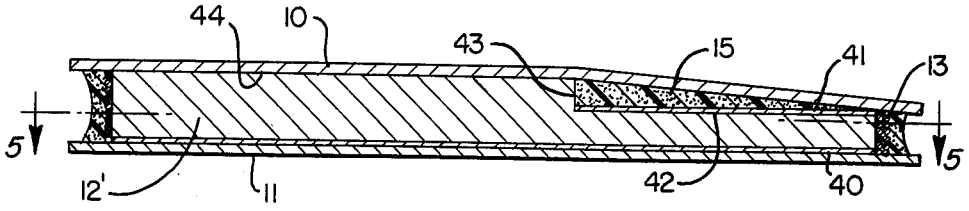
FIG. 4 illustrates a preferred construction of the present invention.

A particularly good contruction of the present invention is illustrated in FIG. 4, which corresponds to the two step edge surface magnet of FIG. 3c. In the arrangement of FIG. 4, however, it has been found that a steel shim 40 disposed along the bottom edge surface of rectangular bar magnet 12',together with the placing of another shorter steel shim 41 on the step edge surface portion 42, considerably enhances the quality of the pickup of the present invention. This structure has been found to increase the power output by increasing the magnetic field, while maintaining the balance of the acoustic pickup at the treble side of the magnet by shielding the strings at the treble side with the shim 41.

The preferred construction of the arrangement of FIG. 4 includes the provision of the rectangular bar magnet 12' with a width dimension of about 0.160 inches over the length of the edge surface portion 44 (a length of about 1½ inches), and the provision of a width dimension of about 0.080 inches over the length of the edge surface portion 42 (about 1 inch). Each of the steel shims 40 and 41 have a thickness of about ten thousandths of an inch with the remaining dimensions thereof conforming to those of the respective bottom edge surface and step edge surface 42 of the bar magnet. In this instance, the cross-sectional thickness of the bar magnet 12', as seen from the end of the magnet, is about 0.125 inches.

Although the arrangement of FIG. 4 is described with respect to a bar magnet having two stepped edge surface portions 42 and 44, the shims 40 and 41 may be used with any magnet construction, such as those previously described, so long as the longer length shim 40 is placed at the bottom edge surface of the magnet away from the strings, while the shorter length shim 41 is arranged at the treble side of the magnet between the magnet and strings.

In each of the embodiments of the above described bar magnets, the cross-section thickness of the magnet, as seen from the end, may range from 0.125 to 0.425 inches. Moreover, the permanent bar magnet may be formed of a rubber magnetic material, an alnico magnetic material, a Cu-Ni-Fe magnetic alloy, or a ceramic magnet.

The two layers 10 and 11 forming the cover structure of the pickup may be a thick hard plastic material of about 0.025 to 0.35 inches in thickness, and each having the same respective dimension, somewhat larger than the length and thickness dimensions of the bar magnet surrounded by the coil 13.

The coil 13 may be a low impedance coil of about 150 to 1000 ohms, and, for example, may be No. 37 wire an impedance of about 200 ohms. The size or gauge of the wire may vary considerably, however, ranging from No. 37 wire to No. 44 wire with corresponding impedance ranging from 200 to 1000 ohms, preferably No. 39 wire wound to 600 ohms.

Figure 5:
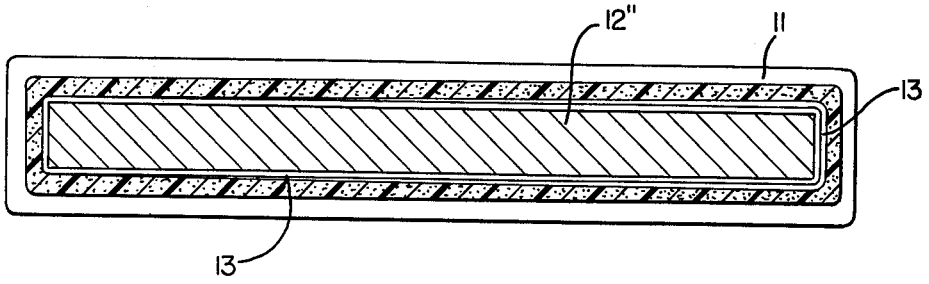
FIG. 5 illustrates an arrangement of the pickup coil of the present invention.

The arrangement of the coil 13 has been found to be of considerable importance in the quality of the pickup of the present invention. As illustrated in FIG. 5, which is a top view of the pickup of this invention, the coil 13 may be wound about the bar magnet 12″ to be tight against the magnet at the wider dimension end, or bass side, while being wound spread-out away from the magnet at the smaller width end, or treble side, of the magnet. This winding occurs as a natural consequence of the winding of the wire about the magnet of different widths in order to maintain the presence of the coil about the body of the magnet, as may be seen by comparing FIGS. 4 and 5, for example. On the other hand, the coil may be wound about the magnet with the area above the stepped edge surface 42, for example, being filled in by the spacer material 15, in such a manner that a part of the coil at the treble side is in contact with the spacer, while the rest of the coil at the treble side is in contact with the magnet. This latter arrangement does not provide multiple layers of the coil about the treble side of the magnet, as occurs in FIG. 5.

The arrangement of FIG. 5, however, has been found to considerably enhance the quality of the acoustic pickup in that the super-high frequencies at the treble side, as well as the super-low frequencies at the bass side, are essentially filtered out.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

What I claim is:

1. An electromagnetic pickup device for musical instruments of the type having elongated magnetizable vibrating elements, said device comprising a single permanent magnet including a configured surface adjacent to all of the magnetizable vibrating elements, said configured surface providing a variation of the magnetic field effecting respective ones of said elements in accordance with the magnetizability of said elements, and a low impedance coil surrounding said permanent magnet.

2. An electromgnetic pickup device according to claim 1, wherein said permanent magnet is a rectangular bar magnet having predetermined length and width dimensions, and being magnetically polarized perpendicularly to said configured surface, and wherein said configured edge surface along said length dimension and provides a varying width dimension of said bar magnet facing said vibrating elements.

3. An electromagnetic pickup device according to claim 2, wherein at least a portion of said configured edge surface is tapered to provide a tapered width dimension of said rectangular bar magnet.

4. An electromagnetic pickup device according to claim 2, wherein the entire configured edge surface is tapered.

5. An electromagnetic pickup device for musical instruments of the type having elongated magnetizable vibrating elements, said device comprising a permanent magnet including a configured surface adjacent the magnetizable vibrating elements, said configured surface providing a variation of the magnetic field effecting respective ones of said elements in accordance with the magnetizability of said elements, and a low impedance coil surrounding said permanent magnet, wherein said permanent magnet is a rectangular bar magnet having predetermined length and width dimensions, and being magnetically polarized perpendicularly to said configured surface, and wherein said configured surface is a configured edge surface along said length dimension and provides a varying width dimension of said bar magnet facing said vibrating elements, and wherein said configured edge surface includes step edge surface portions to provide stepped width dimensions of said rectangular bar magnet.

6. An electromagnetic pickup device according to claim 5, wherein said step edge surface portions provide at least two different width dimensions of said bar magnet.

7. An electromagnetic pickup device according to claim 6, wherein a steel shim is disposed on the step edge surface portion having the lesser of said two different width dimensions, and wherein a second steel shim is disposed along a second edge surface opposite said configured surface.

8. An electromagnetic pickup device for musical instruments of the type having elongated magnetizable vibrating elements, said device comprising a permanent magnet including a configured surface adjacent the magnetizable vibrating elements, said configured surface providing a variation of the magnetic field effecting respective ones of said elements in accordance with the magnetizability of said elements, and a low impedance coil surrounding said permanent magnet, wherein said permanent magnet is a rectangular bar magnet having predetermined length and width dimensions, and being magnetically polarized perpendicularly to said configured surface, and wherein said configured surface is a configured edge surface along said length dimension and provides a varying width dimension of said bar magnet facing said vibrating elements, and wherein said configured edge surface includes at least one notch edge surface portion.

9. An electromagnetic pickup device according to claim 8, wherein said notch edge surface portion provides at least three different width dimensions of said bar magnet.

10. An electromagnetic pickup device for musical instruments of the type having elongated magnetizable vibrating elements, said device comprising a permanent magnet including a configured surface adjacent the magnetizable vibrating elements, said configured surface providing a variation of the magnetic field effecting respective ones of said elements in accordance with the magnetizability of said elements, and a low impedance coil surrounding said permanent magnet, wherein said permanent magnet is a rectangular bar magnet having predetermined length and width dimensions, and being magnetically polarized perpendicularly to said configured surface, and wherein said configured surface is a configured edge surface along said length dimension and provides a varying width dimension of said bar magnet facing said vibrating elements, and wherein said configured edge surface includes notch and step edge surface portions.

11. An electromagnetic pickup device according to claim 10, wherein said notch and step edge surface portions provide at least four different width dimensions of said bar magnet.

12. An electromagnetic pickup device according to claim 10, wherein the edge surface of said bar magnet opposite to said configured surface adjacent said vibrating elements is also configured.

13. An electromagnetic pickup device according to claim 12, wherein said two configured edge surfaces provide at least four different width dimensions of said bar magnet.

14. An electromagnetic pickup device according to claim 1 in combination with an acoustic guitar, wherein said elongated magnetizable vibrating elements are the strings of said guitar.

15. An electromagnetic pickup device for musical instruments of the type having elongated magnetizable vibrating elements, said device comprising a permanent magnet including a configured surface adjacent the magnetizable vibrating elements, said configured surface providing a variation of the magnetic field effecting respective ones of said elements in accordance with the magnetizability of said elements, a low impedance coil surrounding said permanent magnet, and covering means for enclosing said permanent magnet and said coil, wherein said covering means include at least a first plate covering said configured surface and a spacer between at least a portion of said configured surface and said first plate, said spacer providing a taper between said first plate and said configured surface.

16. An electromagnetic pickup device for musical instruments of the type having elongated magnetizable vibrating elements, said device comprising a permanent magnet including a configured surface adjacent the magnetizable vibrating elements, said configured surface providing a variation of the magnetic field effecting respective ones of said elements in accordance with the magnetizability of said elements, and a low impedance coil surrounding said permanent magnet, wherein said permanent magnet is a rectangular bar magnet having predetermined length and width dimensions, and being magnetically polarized perpendicularly to said configured surface, and wherein said configured surface is a configured edge surface along said length dimension and provides a varying width dimension of said bar magnet facing said vibrating elements, and wherein said coil includes conducting means wound around said permanent bar magnet, said conducting means being wound against said bar magnet at an end having larger width dimensions and being overlappingly wound upon itself at an end having smaller width dimensions of said bar magnet.

17. An electromagnetic pickup device for musical instruments of the type having elongated magnetizable vibrating elements, said device comprising a permanent magnet including a configured surface adjacent the magnetizable vibrating elements, said configured surface providing a variation of the magnetic field effecting respective ones of said elements in accordance with the magnetizability of said elements, and a low impedance coil surrounding said permanent magnet, wherein said permanent magnet is a rectangular bar magnet having predetermined length and width dimensions, and being magnetically polarized perpendicularly to said configured surface, and wherein said configured surface is a configured edge surface along said length dimension and provides a varying width dimension of said bar magnet facing said vibrating elements, and wherein a steel shim is disposed along said configured edge surface at a portion of reduced width dimensions, and a second steel shim is disposed along a second edge surface of said rectangular bar magnet opposide said configured edge surface.

18. An electromagnetic pickup device according to claim 15, wherein at least a portion of said configured surface is tapered to provide a tapered width dimension of said magnet.

19. An electromagnetic pickup device according to claim 15, wherein said configured surface includes step edge surface portions to provide stepped width dimensions of said magnet.

20. An electromagnetic pickup device according to claim 15, wherein said configured surface includes notch and step edge surface portions.

21. An electromagnetic pickup device according to claim 15 in combination with an acoustic guitar, wherein said elongated magnetizable vibrating elements are the strings of said guitar.

* * * * *